US007431621B2

(12) United States Patent
Fuse et al.

(10) Patent No.: US 7,431,621 B2
(45) Date of Patent: Oct. 7, 2008

(54) DRIVE SHAFT SUPPORTING STRUCTURE FOR A SMALL BOAT, AND PERSONAL WATERCRAFT INCORPORATING SAME

(75) Inventors: Tomohiro Fuse, Wako (JP); Hiroshi Iwakami, Wako (JP); Tadaaki Nagata, Wako (JP); Takayoshi Miura, Wako (JP); Jo Yoshida, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 141 days.

(21) Appl. No.: 11/389,891

(22) Filed: Mar. 27, 2006

(65) Prior Publication Data

US 2006/0223391 A1 Oct. 5, 2006

(30) Foreign Application Priority Data

Mar. 30, 2005 (JP) ..... 2005-099863

(51) Int. Cl.

| | |
|---|---|
| ***B63H 5/10*** | (2006.01) |
| *B63H 20/32* | (2006.01) |
| *B63H 21/36* | (2006.01) |
| *B63H 5/07* | (2006.01) |

(52) U.S. Cl. ..... 440/82; 440/76; 440/78; 440/79

(58) Field of Classification Search ..... 440/76–79, 440/82, 83

See application file for complete search history.

(56) References Cited

U.S. PATENT DOCUMENTS

| | | | | |
|---|---|---|---|---|
| 5,366,396 | A * | 11/1994 | Schulze | 440/38 |
| 7,198,531 | B2 * | 4/2007 | Nakamura et al. | 440/83 |
| 2006/0014445 | A1 * | 1/2006 | Lawson et al. | 440/47 |

FOREIGN PATENT DOCUMENTS

| | | |
|---|---|---|
| JP | 2004-058871 | 2/2004 |

* cited by examiner

*Primary Examiner*—Jesús D. Sotelo
*Assistant Examiner*—Daniel V Venne
(74) *Attorney, Agent, or Firm*—Carrier, Blackman & Associates, P.C.; William D. Blackman; Joseph P. Carrier

(57) ABSTRACT

A drive shaft supporting structure for a small boat is provided which permits simplification of a hull and for which manufacturing productivity is increased. The drive shaft supporting structure includes a shaft-supporting member for rotatably supporting a drive shaft inside of a hull, and an elongate cylindrical sleeve. The cylindrical sleeve is arranged between the shaft-supporting member and a hull opening which permits penetration of the drive shaft through the hull. The drive shaft supporting structure is configured in such a manner that a front end portion of the cylindrical sleeve is connected to the shaft-supporting member and a rear end portion of the cylindrical sleeve is connected to the hull opening.

16 Claims, 9 Drawing Sheets

DRIVE SHAFT SUPPORTING STRUCTURE FOR A SMALL BOAT, AND PERSONAL WATERCRAFT INCORPORATING SAME

CROSS-REFERENCE TO RELATED APPLICATIONS

The present invention claims priority under 35 USC 119 based on Japanese patent application No. 2005-099863, filed on Mar. 30, 2005. The subject matter of this priority document is incorporated by reference herein.

BACKGROUND OF THE INVENTION

1. Field of the Invention

The present invention relates to a drive shaft supporting structure for a small boat, in which the drive shaft supporting structure rotatably supports a drive shaft which transmits engine output to a water jet pump.

2. Description of the Background Art

Small personal watercraft, which include a boat body composed of a hull and a deck, are well known. In this type of boat, the hull, which constitutes a lower portion of the boat body, is covered with the deck, which constitutes an upper portion of the boat body. An engine is provided in the boat body, and a water jet pump is mounted to a rear portion of the boat body. Water is drawn into the water jet pump via a water introduction channel formed in the bottom of the hull. The water jet pump is driven by the engine, via a drive shaft, and the drawn water is jetted rearwardly in order to propel the boat forward.

The small boat is propelled due to the action of the water jet pump, and is provided with a recess directed downwardly on a rear bottom portion of the hull. The water jet pump is stored in a rear part of the recess, and a part of the recess disposed in front of the pump is configured to be the water introduction channel where water is drawn into the pump.

The drive shaft extends from the engine toward the rear of the boat body, and connects the engine to the water jet pump. In order to connect the engine disposed in the boat body with the water jet pump, disposed in the recess, the drive shaft passes through an opening provided in a wall of the water introduction channel. The drive shaft is rotatably supported within the opening by a drive shaft supporting structure provided on the boat body.

In order to extend the drive shaft from inside the boat body toward the outside thereof, it is necessary to form the opening in the wall of the water introduction channel. Therefore, the drive shaft supporting structure is configured to prevent water from entering the boat body through the opening. Such a configuration is disclosed, for example, in Japanese published patent document JP-A-2004-58871.

The drive shaft supporting structure disclosed in JP-A-2004-58871 is configured in such a manner that an inclined wall, that defines the water introduction channel of the hull, is formed with a recess directed toward the front of the hull. A rubber joint member is inserted into the recess, and a cylindrical portion of the joint member projects from the opening of the recess toward the front of the hull.

A rubber cylindrical fitting member fits on the outside of the cylindrical portion which projects from the opening, and the cylindrical fitting member is tightened onto the cylindrical portion with a tightenable band clamp. For example, a hose clamp can be used to adjustably secure the cylindrical fitting member to the cylindrical portion. Accordingly, the cylindrical fitting member tightly adheres to the cylindrical portion by the tightenable band clamp.

The cylindrical fitting member is integrally formed with a shaft-supporting member, and a flange of the shaft-supporting member is secured to a cover with a bolt. The cover is fixed to the hull. The shaft-supporting member is a bearing that rotatably supports the drive shaft, and a clearance between the bearing and the drive shaft is hermetically sealed with a sealing material. Consequently, the sealing material prevents water that has entered from the interior of the water introduction channel into the cylindrical fitting member from entering into the hull.

Now, a main reason why the recess is formed on the inclined wall of the water introduction channel will be described.

The water introduction channel is a channel for introducing water to the pump, and in order to permit smooth flow of water in the water introduction channel, it is necessary to prevent the joint member from projecting toward the water introduction channel. Therefore, as described above, the recess is formed on the inclined wall of the water introduction channel so as to be directed toward the front of the hull, and the rubber joint member is inserted into the recess. Accordingly, the joint member can be prevented from projecting toward the water introduction channel.

As described above, the hull disclosed in JP-A-2004-58871 is formed with the recess directed toward the front of the hull, and is provided with a cover. Therefore, the shape of the hull is relatively complex, which increases the cost of the hull.

When assembling the drive shaft supporting structure to the hull, the rubber joint member is inserted into the recess of the hull, and the cylindrical portion projects from the opening. Subsequently, the cylindrical fitting member is fitted on the cylindrical portion, and the shaft-supporting member is secured to the cover with a bolt. Then, the tightenable band is tightened to bring the cylindrical fitting member into tight adhesion with the cylindrical portion, whereby assembly of the drive shaft supporting structure to the hull is completed.

The hull is a relatively large member, and hence it is difficult to frequently change the orientation of the hull. Therefore, during the process of assembling the drive shaft supporting structure to the hull, the hull is normally kept in a horizontal orientation with the hull bottom directed downward.

Therefore, when inserting the rubber joint member into the recess of the hull or causing the cylindrical portion to be projected from the opening, the assembler is required to proceed with the assembly operation in a relatively uncomfortable posture in order to align his/her body with the recess of the hull. In the same manner, when fitting the cylindrical fitting member to the cylindrical portion, or bringing the cylindrical fitting member into tight adhesion with the cylindrical portion by tightening the tightenable band clamp, the assembler is required to proceed with the assembly operation in a relatively uncomfortable posture in order to align his/her body with the cylindrical portion.

In this manner, the assembler is required to proceed with the assembling work of the drive shaft supporting structure while maintaining the relatively uncomfortable posture so as to align his/her body with the hull, and as a consequence, manufacturing productivity is impaired.

SUMMARY

The present invention provides a drive shaft supporting structure for a small boat in which the hull is simplified and the productivity of manufacturing the boat can be increased.

In a small boat in which a downwardly directed recess is formed on a rear bottom portion of a hull, a pump is stored in the hull in a rear part of the recess. A front part of the recess is used as a water introduction channel for introducing water to the pump, and an engine is provided in the boat body forward of the water introduction channel. A drive shaft extends rearwardly from the engine in the boat body, and the drive shaft is connected to the pump through an opening provided on a wall of the water introduction channel.

A first aspect of the present invention is characterized in that a shaft-supporting member, that can support the drive shaft so as to be capable of rotating, and a cylindrical sleeve, arranged between the shaft-supporting member and the opening so as to allow passage of the drive shaft therethrough, are mounted to the boat from the inside of the hull. In addition, a front end portion of the cylindrical sleeve is connected to the shaft-supporting member, and a rear end portion of the cylindrical sleeve is connected to the opening.

During installation of the cylindrical sleeve, the front end portion of the cylindrical sleeve is connected to the shaft-supporting member. Then, the rear end portion of the cylindrical sleeve is connected to the opening from a position inside of the hull.

By connecting the rear end portion of the cylindrical sleeve to the opening from the inside of the hull, it is not necessary to form the recess for mounting the cylindrical sleeve on an inclined wall of the water introduction channel, as in the case of the hull in the related art. Accordingly, the shape of the hull can be simplified.

In addition, the shaft-supporting member is also mounted from the inside of the hull, like the cylindrical sleeve. By configuring the cylindrical sleeve and the shaft-supporting member to be mounted from the inside of the hull, the shaft-supporting member can be integrally connected to the cylindrical sleeve, so that the integrated cylindrical sleeve and the shaft-supporting member can be mounted together as a sub-assembly, from the inside of the hull.

Since the cylindrical sleeve and the shaft-supporting member are mounted from the inside of the hull at this time, when connecting the shaft-supporting member to the cylindrical sleeve, the mounting work can be performed from the inside of the hull. Accordingly, the operator can mount the cylindrical sleeve and the shaft-supporting member in an unforced posture, and hence the mounting work of the cylindrical sleeve and the shaft-supporting member can be easily performed.

A second aspect of the invention is characterized in that the shaft-supporting member includes a sealing member for hermetically sealing a clearance between the shaft-supporting member and the drive shaft. A resilient deformable cylindrical fitting member extends rearwardly in the boat body along the periphery of the drive shaft, and the end portion of the cylindrical fitting member is fitted to a front end portion of the cylindrical sleeve.

The cylindrical fitting member of the shaft-supporting member is resiliently deformable, and the cylindrical fitting portion is fitted to the cylindrical sleeve. Therefore, for example, vibrations, generated when the small boat is being propelled, can be absorbed or alleviated by resiliently deforming the cylindrical fitting member. Accordingly, a fitted relationship can be advantageously maintained between the cylindrical fitting member and the cylindrical sleeve. Furthermore, the clearance between the shaft-supporting member and the drive shaft can be hermetically sealed by the sealing member.

In this manner, by maintaining the fitted state between the cylindrical fitting member and the cylindrical sleeve preferably, and hermetically sealing the clearance between the shaft-supporting member and the drive shaft with the sealing member, water that has entered into the cylindrical fitting member or the cylindrical sleeve from the opening can be accumulated in the respective interiors thereof. Accordingly, water that has entered from the opening can be prevented from entering into the boat body.

According to the first aspect of the invention, since it is not necessary to form the recess for mounting the cylindrical sleeve on the inclined wall of the water introduction channel, the shape of the hull is simplified, and the cost manufacturing the hull can be reduced.

According to the first aspect of the invention, by simplifying the operation to connect the shaft-supporting member to the cylindrical sleeve, the operating time is reduced and hence the productivity can be advantageously improved.

According to the second aspect of the invention, by accumulating water that has entered into the cylindrical fitting member or the cylindrical sleeve from the opening in the interior thereof, water can be advantageously prevented from entering into the boat body from the opening.

Modes for carrying out the present invention are explained below by reference to an embodiment of the present invention shown in the attached drawings. The above-mentioned object, other objects, characteristics and advantages of the present invention will become apparent form the detailed description of the embodiment of the invention presented below in conjunction with the attached drawings.

BRIEF DESCRIPTION OF THE DRAWINGS

FIG. 8(*b*) is an explanatory drawing showing a second step of a method by which the shaft-supporting member and the cylindrical cradle member of the drive shaft supporting structure for a small boat according to the illustrative embodiment of the invention are assembled to the hull, and shows the integrated cylindrical cradle member and the shaft-supporting member are fixed to the wall from the inside of the hull.

DETAILED DESCRIPTION

An illustrative embodiment for carrying out the invention will now be described in some detail, with reference to the drawings. It should be understood that only structures considered necessary for clarifying the present invention are described herein. Other conventional structures, and those of ancillary and auxiliary components of the system, are assumed to be known and understood by those skilled in the art. The terms "front", "rear", "left" and "right" are directions as viewed from the vantage point of an the operator of the boat, and reference sign Fr designates a front side, Rr designates a rear side, L designates a left side, and R designates a right side.

Figure 1:
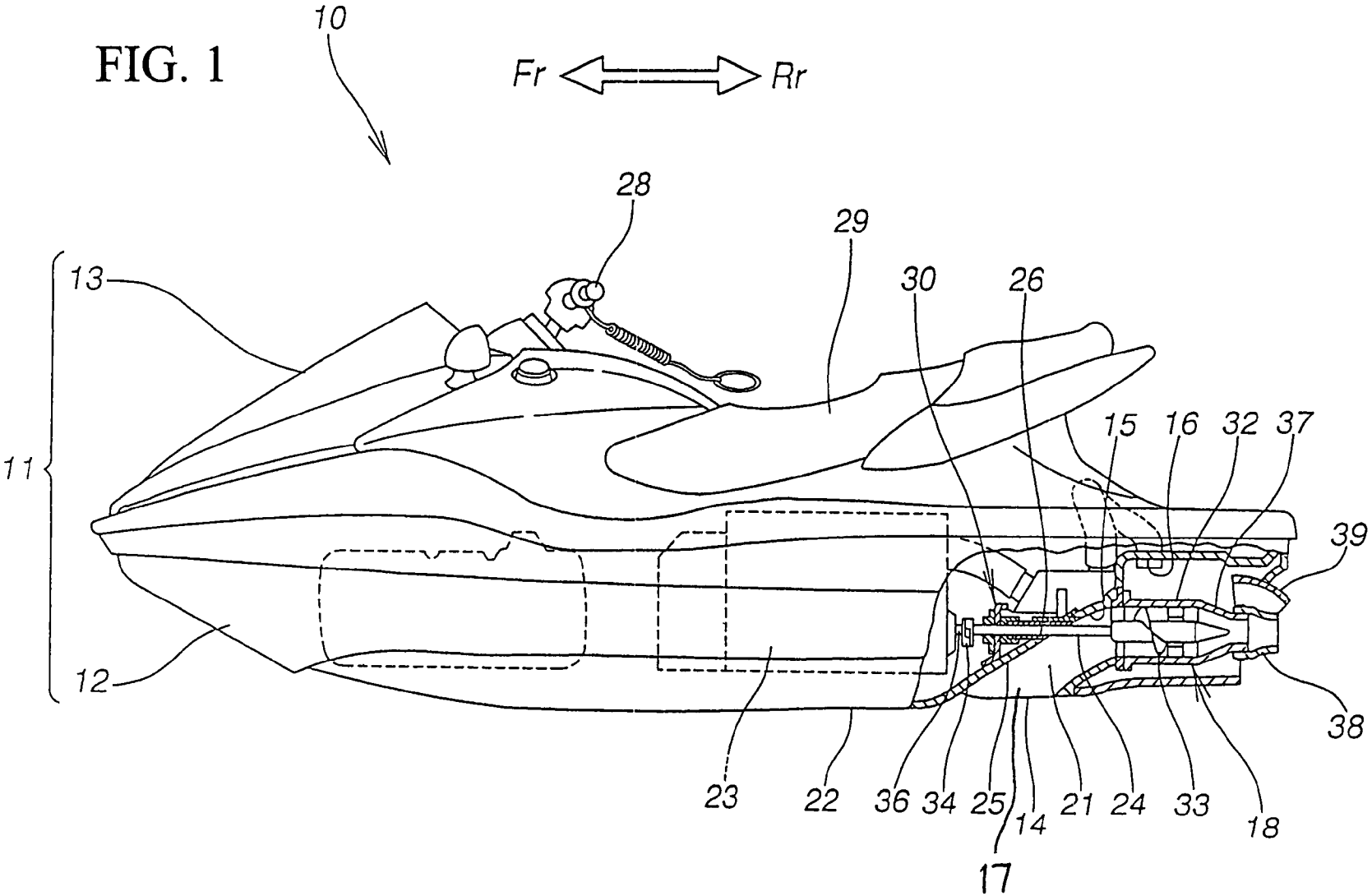
FIG. 1 is a side plan view, partially cut away, of a small boat provided with a drive shaft supporting structure according to an illustrative embodiment of the invention.

FIG. 1 is a side plan view, partially cut away and partially shown in section, of a small boat 10 provided with a drive shaft supporting structure 30 according to an illustrative embodiment of the invention.

The small boat 10, according to the illustrative embodiment of the invention, is a water jet-propelled boat of the type sometimes referred to as a "jet ski" or personal watercraft, and has a structure in which a hull 12 is provided as a lower portion of a boat body 11, and a deck 13, which constitutes an upper portion of the boat body 11, is provided on top of the hull. The deck 13 covers the hull 12 from above.

The hull 12 is configured so that a recess 15 is formed in a rear bottom portion 14 thereof, and this recess includes a water introduction channel 21, which extends from a pickup port 17, located at a rear portion of the hull and directed downwardly, through the rear portion 14 of the hull. The back of the recess 15 is defined by a hollow pump housing 32 which is attached to the hull. A water jet pump (pump) 18 is stored in the pump housing 32 at a rear part 16 of the recess 15. The water introduction channel 21 defines a front part of the recess 15, in front of the water jet pump 18, and the water introduction channel 21 is used as a conduit through which water is drawn into the water jet pump 18.

An engine 23 is disposed in the boat body 11 in front of the water introduction channel 21. An opening 26 is formed in a scoop 25 of the water introduction channel 21, and a drive shaft 24 extends from the engine 23 toward the rear of the boat body 11. A front end portion of the drive shaft 24 is connected to an output shaft 36 of the engine 23, via a coupling joint 34. The drive shaft 24 passes through the opening 26 of the channel wall 56, and is operatively connected to the water jet pump 18. The drive shaft 24 is supported by a drive shaft supporting structure (drive shaft supporting structure of a small boat) 30, as will be described in further detail herein.

The small boat 10 is also provided with a steering handle 28 disposed at a central portion of the deck 13, and a seat 29 is provided on the deck 13 behind the steering handle 28.

The water jet pump 18 is formed by extending the pump housing 32 rearwardly from the water introduction channel 21 of the hull bottom 22, and rotatably arranging an impeller 33 in the pump housing 32. A rear end portion of the drive shaft 24 is connected to the impeller 33, as noted.

Water, drawn from the water introduction channel 21 of the hull bottom 22 by the water jet pump 18, driven by the engine 23 such that the impeller 33 is rotated, is jetted rearwardly outwardly of the boat body 11 from a steering nozzle 38 via a rear nozzle 37 of the pump housing 32. Accordingly, the small boat 10 is propelled in a direction away from the direction of the water jet.

In order to move the small boat 10 in a rearward direction, a reverse bucket 39, disposed above the steering nozzle 38, is moved to a position of reverse travel which is located rearwardly of the steering nozzle 38. When the reverse bucket 39 is in this position, water that is jetted rearward from the steering nozzle 38 is redirected toward the front of the boat body 11 by the reverse bucket 39, whereby the small boat 10 is moved rearwardly by the jetted water.

Figure 2:
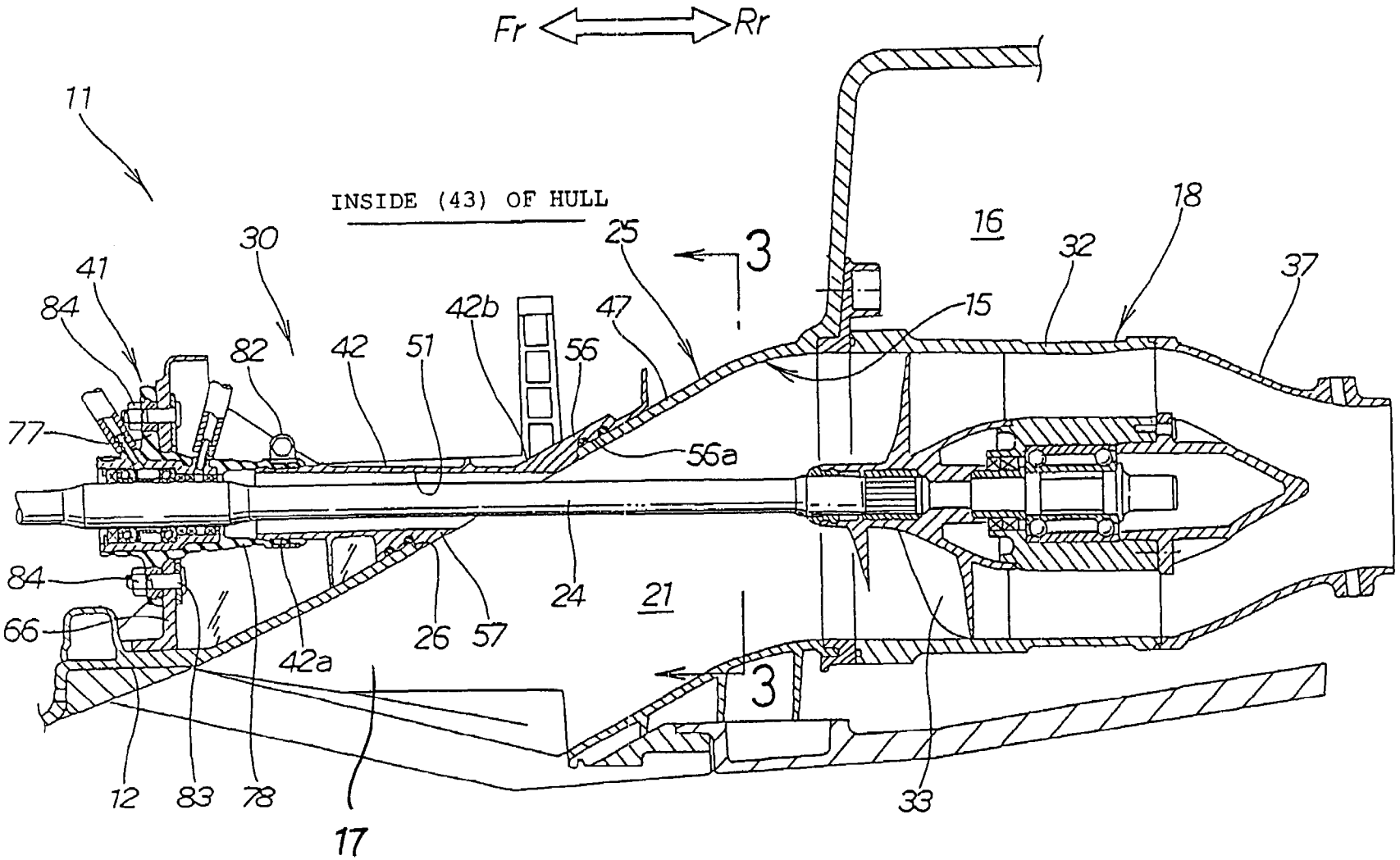
FIG. 2 is a side cross-sectional view of the drive shaft supporting structure for a small boat according to the illustrative embodiment of the invention, showing the drive shaft extending through the drive shaft supporting structure and into the water introduction channel.
Figure 3:
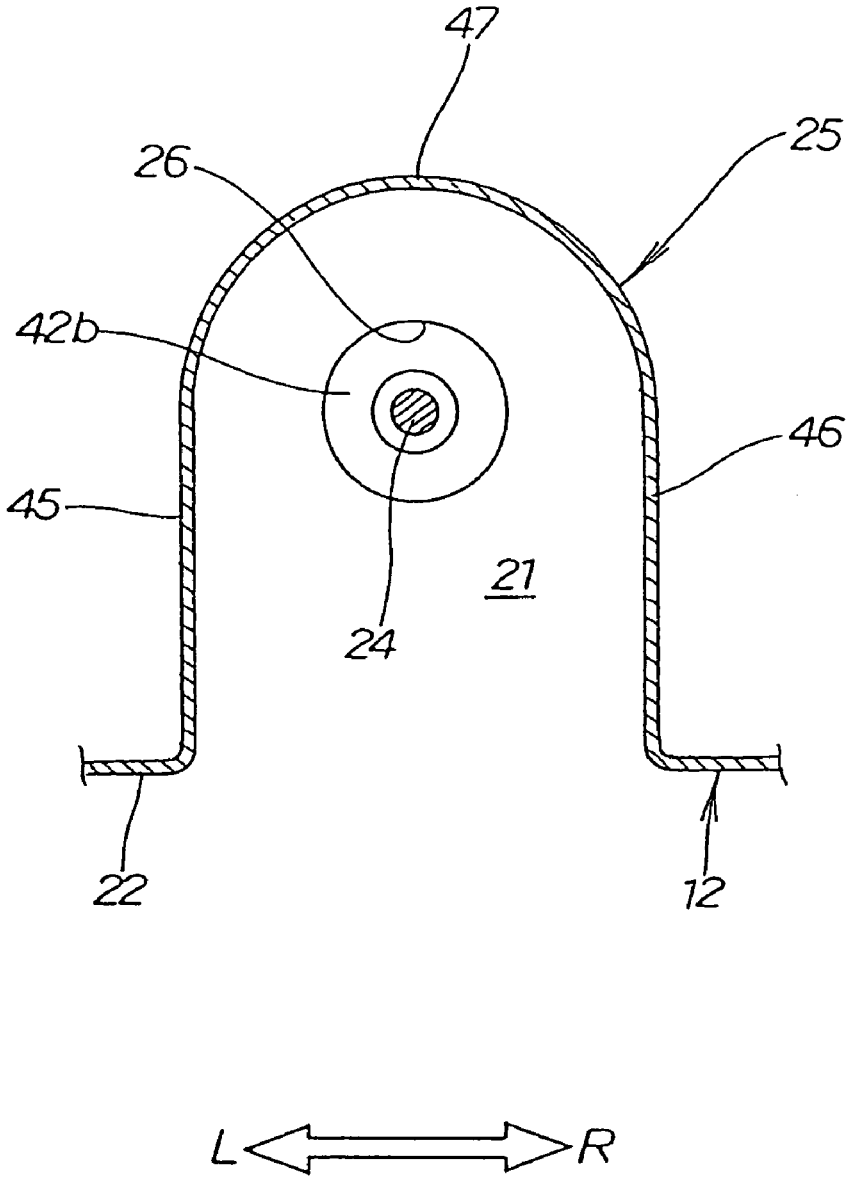
FIG. 3 is a cross-sectional view taken along the line 3-3 in FIG. 2.
Figure 4:
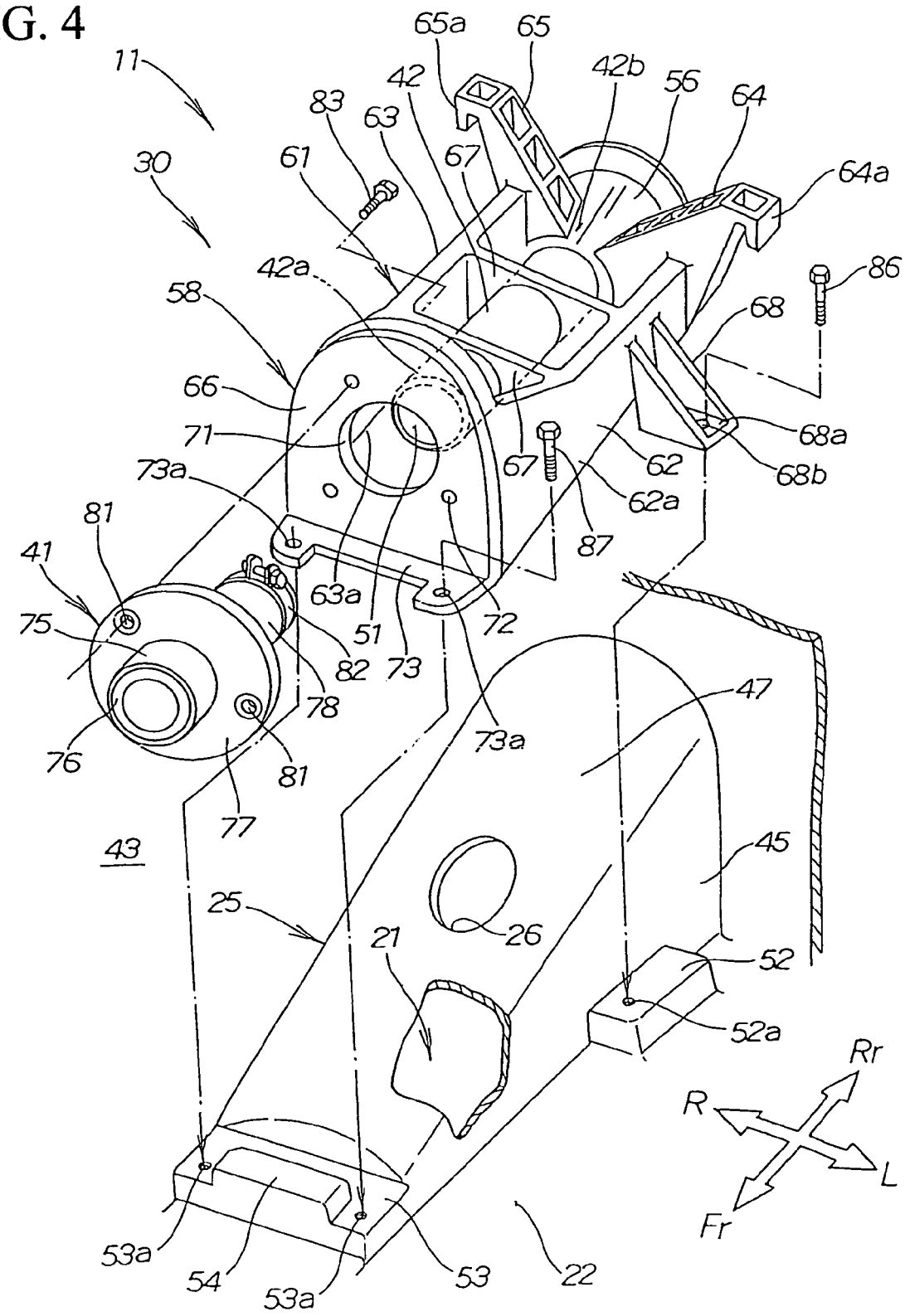
FIG. 4 is an exploded perspective view of the drive shaft supporting structure for a small boat according to the illustrative embodiment of the invention.

FIG. 2 is a cross-sectional view showing the drive shaft supporting structure for a small boat according to the illustrative embodiment of the invention, FIG. 3 is a cross-sectional view taken along the line 3-3 in FIG. 2, and FIG. 4 is an exploded perspective view of the drive shaft supporting structure of FIGS. 2-3.

The drive shaft supporting structure 30 includes a shaft-supporting member 41 at its front end, for rotatably supporting a front end portion of the drive shaft 24 inside of the hull 12. The drive shaft supporting structure 30 also includes an elongate cylindrical sleeve 42, which is arranged extending between the shaft-supporting member 41 and the opening 26 in the scoop 25 of the water introduction channel 21. The cylindrical sleeve 42 allows passage of the drive shaft 24 therethrough inside 43 of the hull 12.

The drive shaft supporting structure 30 is configured in such a manner that a front end 42*a* of the cylindrical sleeve 42 is connected to the shaft-supporting member 41, and a rear end 42*b* of the cylindrical sleeve 42 is connected to the scoop 25 at the opening 26.

The scoop 25 extends toward the rear of the boat body 11 in an upwardly sloping manner. As seen best in FIGS. 3 and 4, the scoop 25 includes left and right side walls 45, 46 extending upwardly from the bottom (hull bottom) 22 of the hull 12. The left and right side walls 45, 46 are generally triangular as viewed from the side, sloping upwardly from narrow portions at the front of the scoop to expanded portions at the rear thereof. The scoop 25 also includes an inclined top wall 47, integrally formed with, and extending between the upper ends of the left and right side walls 45, 46.

The inclined top wall 47 of the scoop 25 has an oval-shaped opening 26 formed therein at substantially a longitudinal center of the water introduction channel 21, which also corresponds to a widthwise center of the boat body 11. Since the oval-shaped opening 26 is formed on the inclined top wall 47, when it is viewed from a horizontal direction, as shown in FIG. 3, it assumes a substantially circular shape.

The rear end 42*b* of the cylindrical sleeve 42 is connected to the opening 26. The cylindrical sleeve 42 is formed with a hollow passage 51 therein, and the drive shaft 24 passes through the passage 51 of the sleeve. Accordingly, the drive shaft 24 extends rearwardly in the boat body from the engine 23 side shown in FIG. 1, through the sleeve passage 51, through the opening 26 of the scoop 25, into the water introduction channel 21, and then extends further from the water introduction channel 21 to the water jet pump 18, and is connected with the impeller 33 of the waterjet pump 18.

FIG. 4 is an exploded perspective view showing the drive shaft supporting structure for a small boat according to the illustrative embodiment of the invention.

The scoop 25 of the water introduction channel 21 is provided with a left anchor boss 52 formed integrally thereon on the outside of the rear portion of the left wall 45, and a left mounting hole 52*a* is formed in the left anchor boss 52. The scoop 25 is also provided with a corresponding right anchor boss 52 (not shown) on the outside of the rear portion of the right wall 46 (see FIG. 3), and a right mounting hole (not shown) is formed in the right anchor boss.

The scoop 25 is further provided with a front anchor boss 53 adjacent to the front end of the inclined top wall 47. A protruding portion 54 is formed at a center of the front anchor boss 53, and front mounting holes 53*a*, 53*a* are formed respectively on the left and right ends of the front anchor boss 53.

The cylindrical sleeve 42 extends in the fore-and-aft direction of the boat body 11, and is formed with the passage 51 extending therethrough, from the front end 42*a* to the rear end 42*b* thereof. An expanded portion 56 and a projection 57 (see FIG. 2) are provided at the top and bottom, respectively, of the rear end portion 42*b* of the cylindrical sleeve 42. The passage 51 of the cylindrical sleeve 42 allows penetration of the drive shaft 24 (see FIG. 2) therethrough. The cylindrical sleeve 42 is affixed to the scoop 25 with an adhesive agent at the expanded portion 56, and the projection 57 is fitted into the opening 26.

The cylindrical sleeve 42 is provided with a reinforced support structure 61 for supportively and stably holding the sleeve 42 therein. The support structure 61 includes a housing having left and right side walls 62, 63 arranged on the left and right sides of the cylindrical sleeve 42. The rear end of the left side wall 62 is connected to a left hook member 64, and the rear end of the right side wall 63 is connected to a right hook member 65. The support structure 61 is also provided with a front support wall 66 at the front end thereof, attached to the left and right side walls 62, 63. The support structure 61 is also provided with intermediate reinforcing panels 67, 67 extending substantially vertically thereacross between the left and right side walls 62, 63, as shown in FIG. 4. The intermediate reinforcing panels 67, 67 are aligned in parallel to the front wall 66, and disposed at spaced intervals in the housing between the front wall 66 and the rear end of the cylindrical sleeve 42. The cylindrical sleeve 42 is supported by the reinforcing panels 67, 67 and by the front wall 66, which have respective holes formed centrally therein to allow the cylindrical sleeve 42 to pass therethrough.

The left hook member 64 extends leftward and upward from the left side of the expanded portion 56, and is provided with a left hook strip 64*a* at a distal end thereof. The right hook member 65 extends rightward and upward from the right side of the expanded portion 56, and is provided with a right hook strip 65*a* at a distal end thereof. The left and right hook members 64, 65 support a muffler thereon. The muffler is secured to the left and right hook members 64, 65 by hooking up a belt (not shown) with the left and right hook strips 64*a*, 65*a*.

The left side wall 62 extends in the fore-and-aft direction of the boat body 11, and a lower edge 62*a* is formed to slope upward in a rearward direction of the boat body 11 so as to be capable of abutting against the left wall 45 of the water introduction channel 21, and a leg portion 68 extends outwardly from, and is disposed adjacent the rear end of the left side wall 62 so as to extend outwardly toward the lateral side of the boat 11. A mounting hole 68*b* is formed in a base 68*a* of a leg portion 68. The right side wall 63 has bi-lateral mirror image symmetry with the left side wall 62, and the respective components are designated by the same reference numerals as the left side wall 62, and redundant description will be omitted.

The front wall 66 includes an opening 71 at a central portion thereof, and three mounting holes 72 are located spaced around the opening 71 at regular intervals. The support structure 61 also includes a front mounting flange 73 that protrudes forward from a lower end of the front wall 66, with mounting holes 73*a* formed on the left and right ends of the front mounting flange 73. The cylindrical sleeve 42, the support structure 61, and the left and right hook members 64, 65 constitute a generally cylindrical cradle member 58.

The shaft-supporting member 41 is mounted on the front wall 66 of the cylindrical cradle member 58. The shaft-supporting member 41 includes a bearing member 76 disposed in a cylindrical leading portion 75, and a flange 77 extending radially outward from the outer wall of the cylindrical leading portion 75. The shaft-supporting member 41 also includes a trailing cylindrical fitting portion 78 extending from the rear end of the cylindrical leading portion 75 in the rearward direction of the boat.

The cylindrical leading portion 75 is formed so as to be capable of being inserted into the opening 71 of the front wall 66. The flange 77 is formed with three mounting holes 81 (one of them is not shown in the drawing), the three mounting holes disposed about the flange 77 at regular intervals on the same circular arc. The mounting holes 81 are positioned so as to be aligned with respective mounting holes 72 formed on the front wall 66. The flange 77 is mounted to the front wall 66 the mounting holes 81.

The trailing cylindrical fitting portion 78 is resiliently deformable, and is formed into a cylindrical shape so that a rear end portion (end portion) 78*a* thereof can be fitted on to the front end portion 42*a* of the cylindrical sleeve 42. The trailing cylindrical fitting portion 78 is provided with a tightenable band clamp 82 at the rear end portion 78*a* thereof. The tightenable band clamp 82 may be a hose clamp, for example.

The trailing cylindrical fitting portion 78 is inserted into the opening 71 of the front wall 66, and the rear end portion 78*a* of the trailing cylindrical fitting portion 78 is fitted about the front end portion 42*a* of the cylindrical sleeve 42. Then, bolts 83 are inserted into the mounting holes 81 of the flange 77 and the mounting holes 72 of the front wall 66, and nuts 84 (see FIG. 2) are tightened onto bolts 83, which project from the mounting holes 81, whereby the flange 77 is fixed to the front wall 66.

After having fixed the flange 77 to the front wall 66, the tightenable band clamp 82 is tightened. Accordingly, the shaft-supporting member 41 is mounted to the cylindrical cradle member 58, and hence the cylindrical cradle member 58 and the shaft-supporting member 41 are integrated as a unitary subassembly.

The integrated cylindrical cradle member 58 and the shaft-supporting member 41 are fixed to the scoop 25 from the inside 43 of the hull 12. More specifically, an adhesive agent is applied to a bonding surface 56*a* of the expanded portion 56 of the cylindrical sleeve 42 facing the scoop 25 (see FIG. 2), and an adhesive agent is applied to the lower edge 62*a* of the left side wall 62 and the lower edge 63*a* of the right side wall 63, respectively.

The cylindrical cradle member 58 is placed on top of the scoop 25, and the passage 51 of the cylindrical sleeve 42 faces the opening 26 of the scoop 25. The left and right leg portions 68, 68 of the cylindrical cradle member 58 are placed on the left and right anchor bosses 52, 52 (the right one is not shown in the drawing), and the front mounting flange 73 is placed on the front anchor boss 53.

A bolt 86 is inserted into the mounting hole 68*b* of the left leg portion 68 and the mounting hole 52*a* of the left anchor boss 52. In the same manner, a second bolt 86 is inserted into the mounting hole of the right leg portions and the mounting hole of the right anchor boss. Then, bolts 87, 87 are inserted into the mounting holes 73*a*, 73*a* of the front mounting flange 73 and the mounting holes 53*a*, 53*a* of the front anchor boss 53. By tightening the inserted bolts 86, 86, 87, 87, the cylindrical cradle member 58 is reliably fixed to the scoop 25.

In this manner, the front end portion 42*a* of the cylindrical sleeve 42 is connected to the rear end portion 78*a* of the trailing cylindrical fitting portion 78, and the rear end portion 42*b* of the cylindrical sleeve 42 is connected to the opening 26 from the inside 43 of the hull 12. By connecting the rear end portion 42*b* of the cylindrical sleeve 42 to the opening 26 from the inside 43 of the hull 12, it is not necessary to form a complicated recess into the molded shape of the inclined wall of the water introduction channel for mounting the cylindrical sleeve, as was necessary in the case of the hull in the related art. Accordingly, the shape of the hull 12 is simplified.

The reason why the bolts 86, 86, 87, 87 are employed as means for fixing the cylindrical cradle member 58 to the scoop 25 is as follows.

The cylindrical cradle member 58 is provided with the left and right hook strips 64*a*, 65*a*, and by hooking up a belt (not shown) with the left and right hook strips 64*a*, 65*a*, the left and right hook members 64, 65 support the muffler.

Therefore, it is considered that a relatively large load is applied to the cylindrical cradle member 58 during use. Therefore, the cylindrical cradle member 58 is configured to have sufficient strength to accept the load, by fixing the cylindrical cradle member 58 to the scoop 25 with the bolts 86, 86, 87, 87.

It is understood, therefore, that when the left and right hook strips 64*a*, 65*a* are not provided on the cylindrical cradle member 58, it is possible to alternatively fix the cylindrical cradle member 58 to the scoop 25 using only an adhesive agent.

Figure 5:
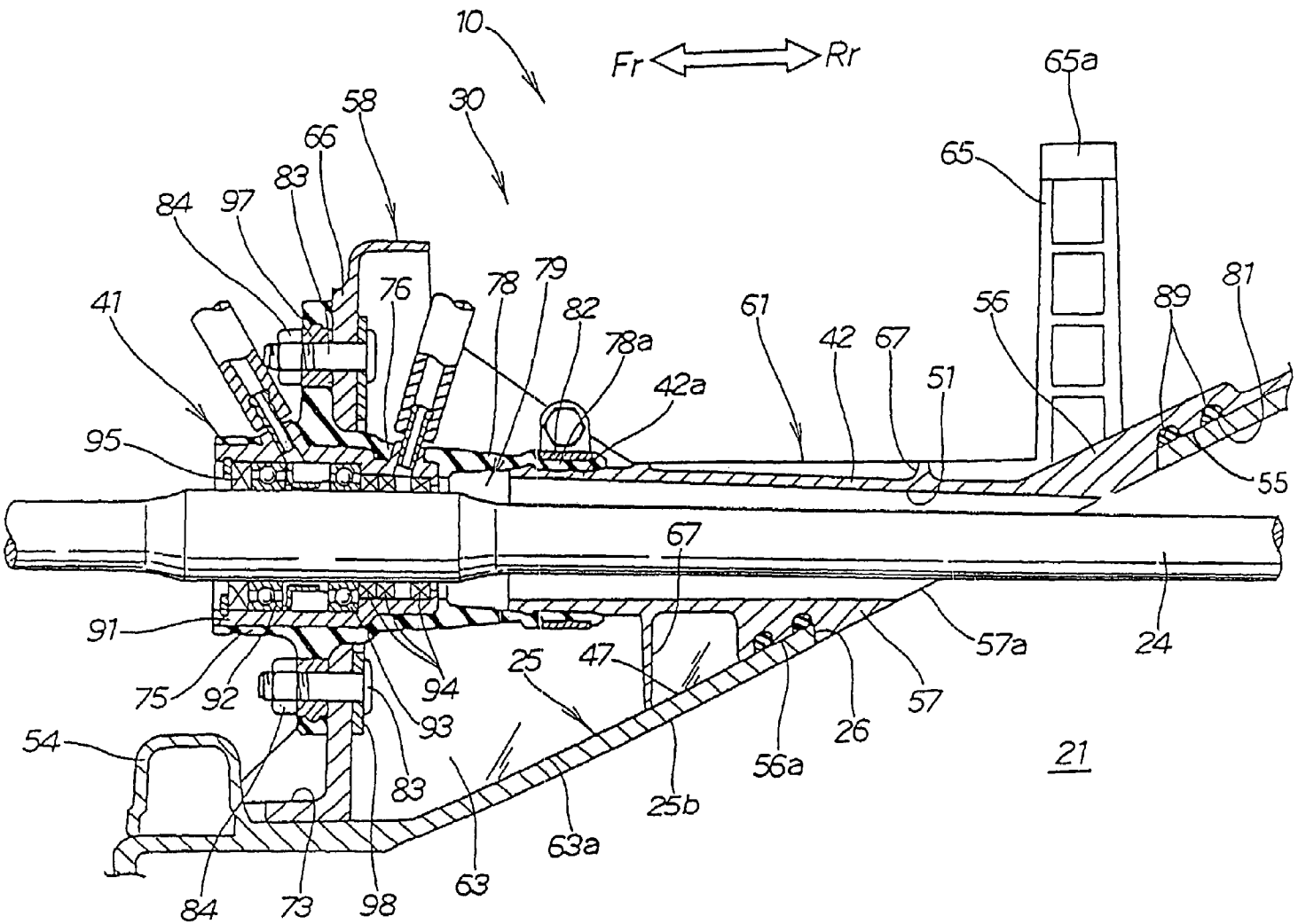
FIG. 5 is an enlarged side cross-sectional view of a principal portion of the drive shaft supporting structure showing the rear end of the cylindrical fitting member disposed about the front end of the elongate cylindrical sleeve 42, and secured thereon using a hose clamp.

FIG. 5 is an enlarged view of a principal portion of the invention showing the drive shaft supporting structure of a small boat.

By fixing the cylindrical cradle member 58 on the scoop 25, the expanded portion 56 of the cylindrical sleeve 42 comes into abutment with the inclined top wall 47 of the scoop 25, and the passage 51 faces, and communicates with, the water introduction channel 21.

By fitting the rear end portion 78*a* of the trailing cylindrical fitting portion 78 to the front end portion 42*a* of the cylindrical sleeve 42, and tightening the band clamp 82 therearound, the passage 51 of the cylindrical sleeve 42 faces, and communicates with, an internal space 79 of the trailing cylindrical fitting portion 78. Therefore, the internal space 79 of the trailing cylindrical fitting portion 78 communicates with the water introduction channel 21 via the passage 51.

The bearing member 76 is provided in a front portion of the internal space 79 of the shaft-supporting member 41, and is coaxial with the trailing cylindrical fitting portion 78 and the cylindrical sleeve 42. The drive shaft 24 is rotatably supported by the bearing member 76, so that the drive shaft 24 can be introduced to the water introduction channel 21 via the internal space 79 of the trailing cylindrical fitting portion 78 and the passage 51.

Figure 6:
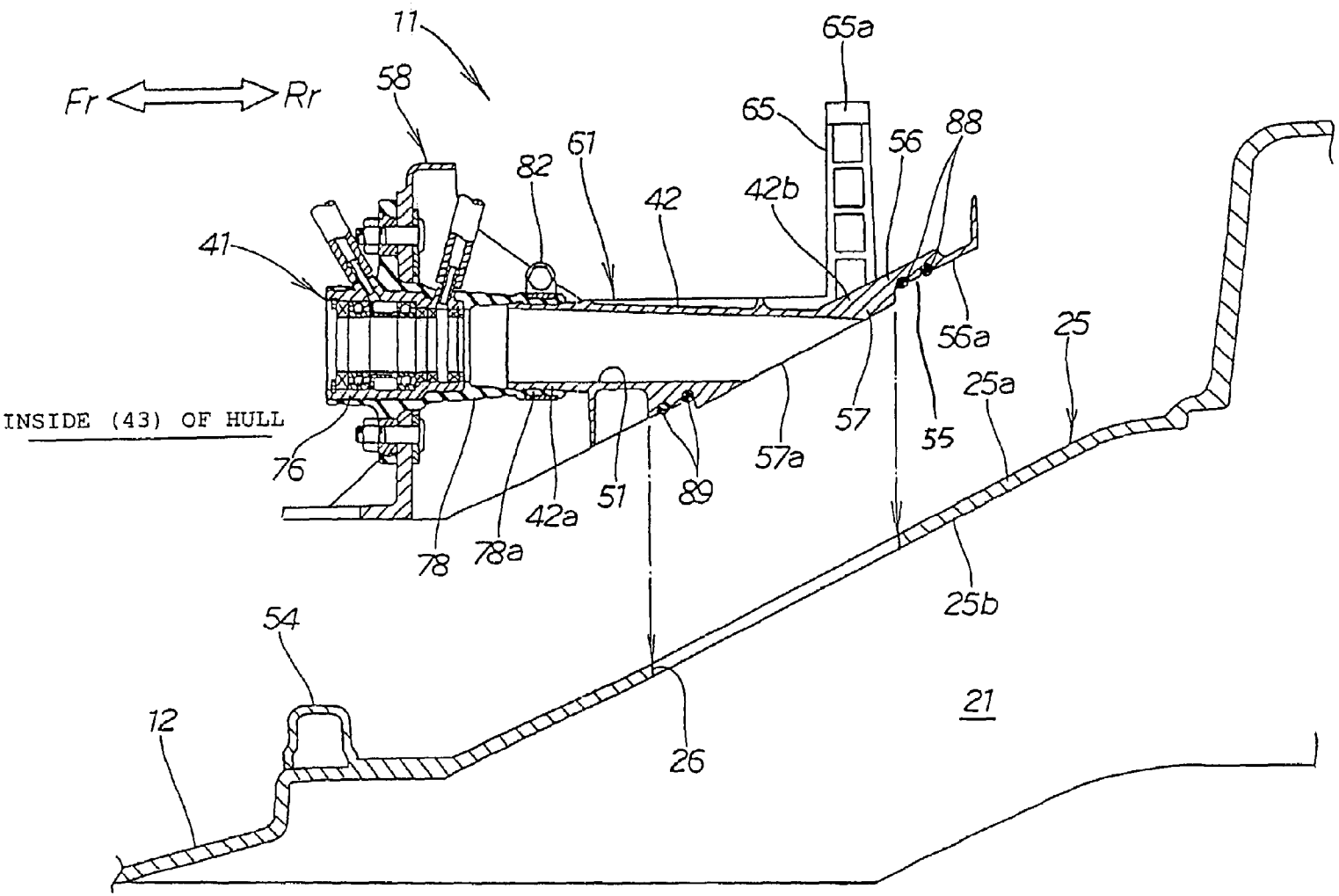
FIG. 6 is a cross-sectional view of the cylindrical cradle member of the drive shaft supporting structure for a small boat according to the illustrative embodiment of the invention showing a state in which the cylindrical cradle member is disassembled from the hull.

FIG. 6 is a side cross-sectional view of the cylindrical cradle member 58 according to the illustrative embodiment of the invention, showing a state in which the cylindrical cradle member is disassembled from the hull.

The cylindrical sleeve 42 includes the expanded portion 56 at its rear end 42*b* formed so as to follow a surface 25*a* of the scoop 25. The expanded portion 56 is formed in the shape of a generally annular plate, and extends at an angle relative to a longitudinal axis of the cylindrical sleeve 42. In other words, the expanded portion 56 is formed to follow the upper surface 25*a* of the scoop 25 rearwardly in the boat body 11 in an upward sloping manner, and is also formed into a curved shape in the widthwise direction of the boat body 11.

A rear face 55 of the expanded portion 56 includes a bonding surface 56*a* which faces the upper surface 25*a* of the scoop 25, and is formed with the projection 57 extending in a rearward direction of the boat. The projection 57 is shaped to be fitted into the opening 26 of the scoop 25, and first and second sealing grooves 88, 88 are formed on the rear face 55 outside of the projection 57, along the outer periphery of the projection 57, between the projection 57 and a peripheral edge of the expanded portion 56.

The projection 57 is formed so that the outer periphery of the projection 57 comes into tight adhesion with a peripheral edge of the opening 26, and the surface 57*a* aligns flush with an inner surface 25*b* of the scoop 25, when the projection 57 is fitted to the opening 26.

First and second O-rings 89, 89 are fitted to the first and second sealing grooves 88, 88 respectively. The first and second O-rings 89, 89 provide a tight seal between the bonding surface 56*a* and the upper surface 25*a* of the scoop 25.

Returning to FIG. 5, the bonding surface 56*a* of the expanded portion 56 is brought into abutment with the upper surface 25*a* of the scoop 25, and the bonding surface 56*a* is adhered to the upper surface 25*a* with an adhesive agent. Then, the lower edge 62*a* (see FIG. 4) of the left side wall 62 and the lower edge 63*a* of the right side wall 63 are brought into abutment with the upper surface 25*a* of the scoop 25, and the lower edges 62*a*, 63*a* are respectively adhered to the upper surface 25*a*. Accordingly, the cylindrical cradle member 58 is fixed to the scoop 25, and the elongate cylindrical sleeve 42 is maintained in an orientation in which it extends in a forward direction of the boat body 11.

Figure 7:
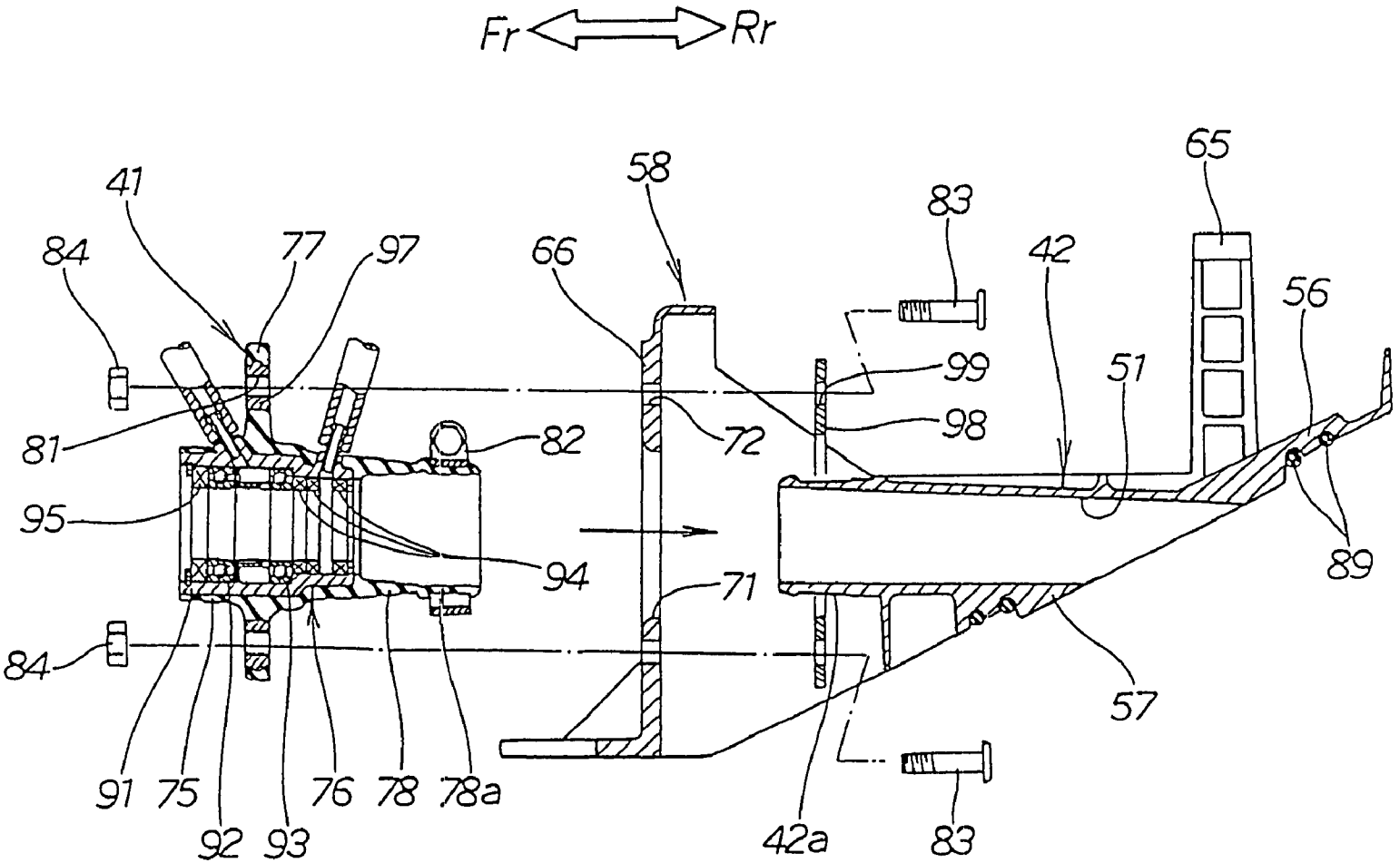
FIG. 7 is a cross-sectional view of the drive shaft supporting structure for a small boat according to the illustrative embodiment of the invention showing a state in which the shaft-supporting member is disassembled from the cylindrical cradle.

FIG. 7 is a side cross-sectional view of the drive shaft supporting structure for a small boat according to the illustrative embodiment of the invention showing a state in which the shaft-supporting member 41 is disassembled from the cylindrical cradle 58.

The shaft-supporting member 41 includes the cylindrical leading portion 75 having a cylindrical shape extending in the fore-and-aft direction of the boat body 11 (see FIG. 1), and the bearing member 76. The bearing member 76 is stored in the cylindrical leading portion 75 in a state in which the bearing member 76 is tightly adhered to the cylindrical leading portion 75. The shaft-supporting member 41 also includes the flange 77 provided on the outer wall of the cylindrical leading portion 75, a metallic reinforcing ring 97 embedded in the flange 77, and the trailing cylindrical fitting portion 78 extending from the rear end of the cylindrical leading portion 75. The trailing cylindrical fitting portion 78 extends in a rearward direction of the boat body 11.

The cylindrical leading portion 75, the flange 77 and the trailing cylindrical fitting portion 78 are integrally formed of a resiliently deformable material. Therefore, the trailing cylindrical fitting portion 78 is a resiliently deformable member. The trailing cylindrical fitting portion 78 is a cylindrical member extending rearwardly in the boat body 11 from the cylindrical leading portion 75 along the periphery of the drive shaft 24.

The bearing member 76 includes front and rear bearings 92, 93 housed in a tubular collar member 91. Three rear sealing members 94, 94, 94 are disposed within the tubular member at a location rearward of the rear bearing 93, and a front sealing member 95 is disposed within the tubular member at a location forward of the front bearing 92. A metallic reinforcing ring 97 is embedded in the flange 77, whereby the flange 77 is reinforced by the reinforcing ring 97.

When mounting the shaft-supporting member 41 to the cylindrical cradle member 58, the trailing cylindrical fitting portion 78 is inserted through the opening 71 of the front wall 66, as shown by the arrow in FIG. 7. The rear end portion 78*a* of the trailing cylindrical fitting portion 78 is fitted about the front end portion 42*a* of the cylindrical sleeve 42, and the tightenable band clamp 82 is subsequently tightened. Accordingly, the front end portion 42*a* of the sleeve 42 and the rear end portion 78*a* of the shaft-supporting member 41 are integrally connected in a state such that a hermetical and watertight seal is achieved therebetween.

The flange 77 is brought into abutment with the front wall 66 and the bolts 83 are inserted into the mounting holes 99 of the ring 98, the mounting holes 72 of the front wall 66, and the mounting holes 81 of the flange 77 (that is, the mounting holes of the reinforcing ring 97). The nuts 84 are tightened to the bolts 83 which project from the mounting holes 81.

The metallic reinforcing ring 97 is embedded in the flange 77, and the bolt 83 passes through the reinforcing ring 97, whereby the flange 77 is firmly fixed to the front wall 66. In this manner, the cylindrical cradle member 58 and the shaft-supporting member 41 are maintained in an integrated state by fixing the flange 77 to the front wall 66.

Returning back to FIG. 5, a clearance between the front end portion 42*a* of the cylindrical sleeve 42 and the rear end portion 78*a* of the trailing cylindrical fitting portion 78 is hermetically sealed. Then, by forming the trailing cylindrical fitting portion 78 to be resiliently deformable, for example, vibrations generated while the small boat 10 is propelled are alleviated by the resiliently deformation of the trailing cylindrical fitting portion 78. Accordingly, water in the internal space 79 or the passage 51 is prevented from being leaked from between the front end portion 42*a* and the rear end portion 78*a* into the boat body 11.

The bearing member 76 is stored in the cylindrical leading portion 75 of the shaft-supporting member 41, and the drive shaft 24 is rotatably supported by the bearing member 76. The bearing member 76 is provided with the front and rear bearings 92, 93 disposed in the tubular member 91, and the drive shaft 24 is rotatably supported by the front and rear bearings 92, 93.

The sealing members 94, 94, 94, are provided rearwardly of the rear bearing 93, whereby a clearance between the bearing member 76 and the drive shaft 24 is hermetically sealed by the sealing members 94, 94, 94. Accordingly, water in the internal space 79 is prevented from leaking into the boat body 11 from between the bearing member 76 and the drive shaft 24.

Subsequently, referring to FIG. 8 to FIG. 9, an assembly procedure of the drive shaft supporting structure 20 for a small boat will be described.

Figure 8:
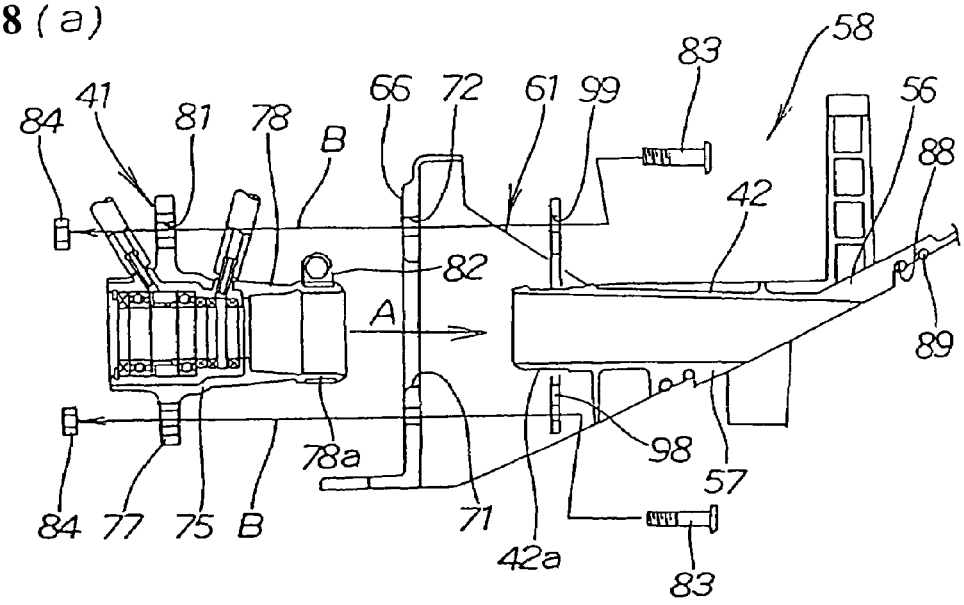
FIG. 8(*a*) is an explanatory drawing showing a first step of a method by which the shaft-supporting member and the cylindrical cradle member of the drive shaft supporting structure for a small boat according to the illustrative embodiment of the invention are assembled to the hull, and shows that the cylindrical fitting member and the outer cylindrical portion of the shaft-supporting member is inserted through the opening of a support wall as indicated by an arrow A.
Figure 8:
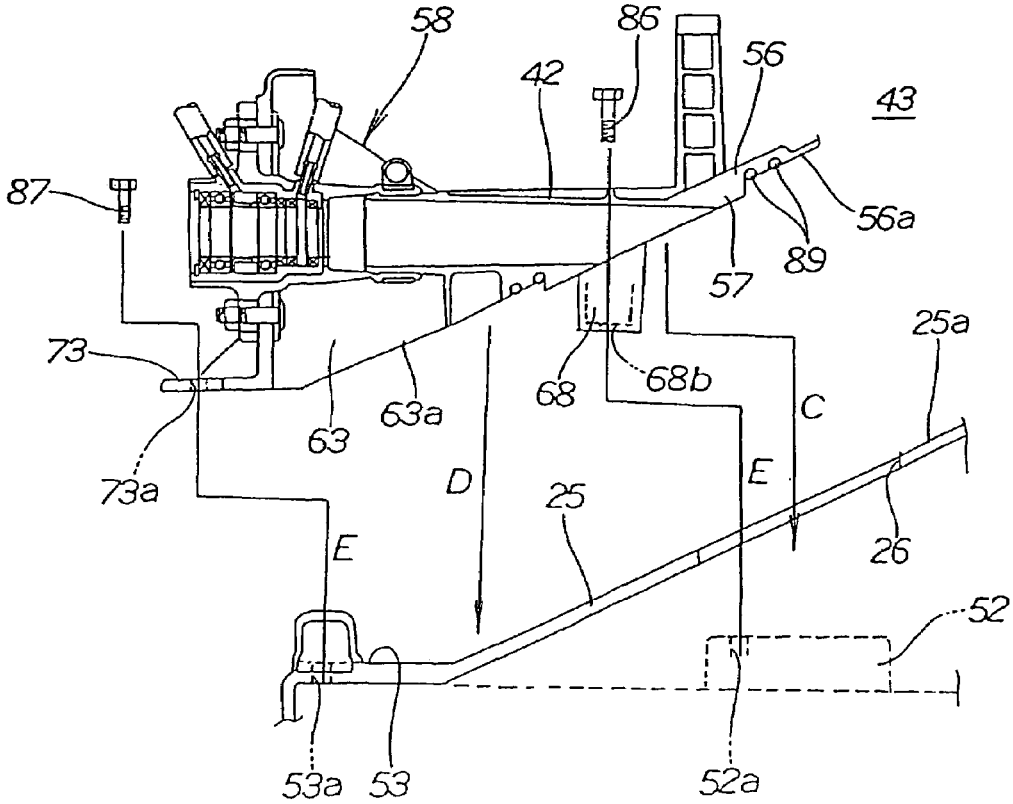

FIGS. 8(*a*), and 8(*b*) are explanatory drawings showing the steps for assembling the shaft-supporting member and the cylindrical cradle member of the drive shaft supporting structure assembled to the hull.

In FIG. 8(*a*), the trailing cylindrical fitting portion 78 and the cylindrical leading portion 75 of the shaft-supporting member 41 is inserted through the opening 71 of the front wall 66 as indicated by an arrow A. The rear end portion 78*a* of the trailing cylindrical fitting portion 78 is fitted about the front end portion 42*a* of the cylindrical sleeve 42, and the flange 77 of the shaft-supporting member 41 is brought into abutment with the front wall 66. When the rear end portion 78*a* is fitted about the front end portion 42*a*, then the tightenable band clamp 82 is tightened.

In this state, the bolts 83 are inserted into the mounting holes 99 of the ring 98, the mounting holes 72 of the front wall 66, and the mounting holes 81 of the flange 77 as indicated by an arrow B. The nuts 84 are tightened to the bolts 83 projecting from the mounting holes 83, so that the flange 77 is fixed to the front wall 66. Accordingly, the shaft-supporting member 41 is mounted integrally to the cylindrical cradle member 58.

In FIG. 8(*b*), the integrated cylindrical cradle member 58 and the shaft-supporting member 41 are fixed to the scoop 25 from the inside 43 of the hull 12.

More specifically, the bonding surface 56*a* of the expanded portion 56 is brought into abutment with the upper surface 25*a* of the scoop 25 as indicated by an arrow C, and the projection 57 is fitted into the opening 26. Then, the bonding surface 56*a* is bonded to the upper surface 25*a* with an adhesive agent. At the same time, the lower edge 62*a* of the left side wall 62 (see FIG. 4) and the lower edge 63*a* of the right side wall 63 are brought into abutment with the upper surface 25*a* of the scoop 25 as indicated by an arrow D. Then, the respective lower edges 62*a*, 63*a* are adhered to the upper surface 25*a* with the adhesive agent. Accordingly, the shaft-supporting member 41 and the cylindrical cradle member 58 are fixed to the scoop 25.

At this time, the left and right leg portions 68, 68 of the cylindrical cradle member 58 are placed on the left and right anchoring bases 52, 52 (the left one is shown in FIG. 4), and the front mounting flange 73 is placed on the front anchoring boss 53. The bolt 86 is inserted into the mounting hole 68*b* of the left leg portion 68 (see FIG. 4) and the mounting hole 52*a* of the left anchoring boss 52 (see FIG. 4). In the same manner, the second bolt 86 is inserted into the mounting hole 68*b* of the right leg portion 68 and the mounting hole 52*a* of the right anchoring boss 52.

Then, the bolts 87, 87 are inserted into the mounting holes 73*a*, 73*a* of the front mounting flange 73 and the mounting holes 53*a*, 53*a* of the front anchoring boss 53. The inserted bolts 86, 86, 87, 87 are tightened. Accordingly, the shaft-supporting member 41 and the cylindrical cradle member 58 are fixed to the scoop 25 further firmly.

As described above, the cylindrical cradle member 58 and the shaft-supporting member 41 are members provided inside 43 of the hull 12. By configuring the cylindrical cradle member 58 and the shaft-supporting member 41 to be provided inside 43 of the hull 12, the shaft-supporting member 41 is integrally connected to the cylindrical cradle member 58, and the integrated cylindrical cradle member 58 and shaft-supporting member 41 is mounted from the inside 43 of the hull 12.

Since the cylindrical cradle member 58 and the shaft-supporting member 41 are mounted from the inside 43 of the hull 12 at this time, when connecting the shaft-supporting member 41 to the cylindrical cradle member 58, the mounting work can be performed from the inside 43 of the hull 12. Accordingly, the operator can mount the cylindrical cradle member 58 or the shaft-supporting member 41 in an unforced posture, and hence the mounting work of these members 41, 58 can be performed easily.

Figure 9:
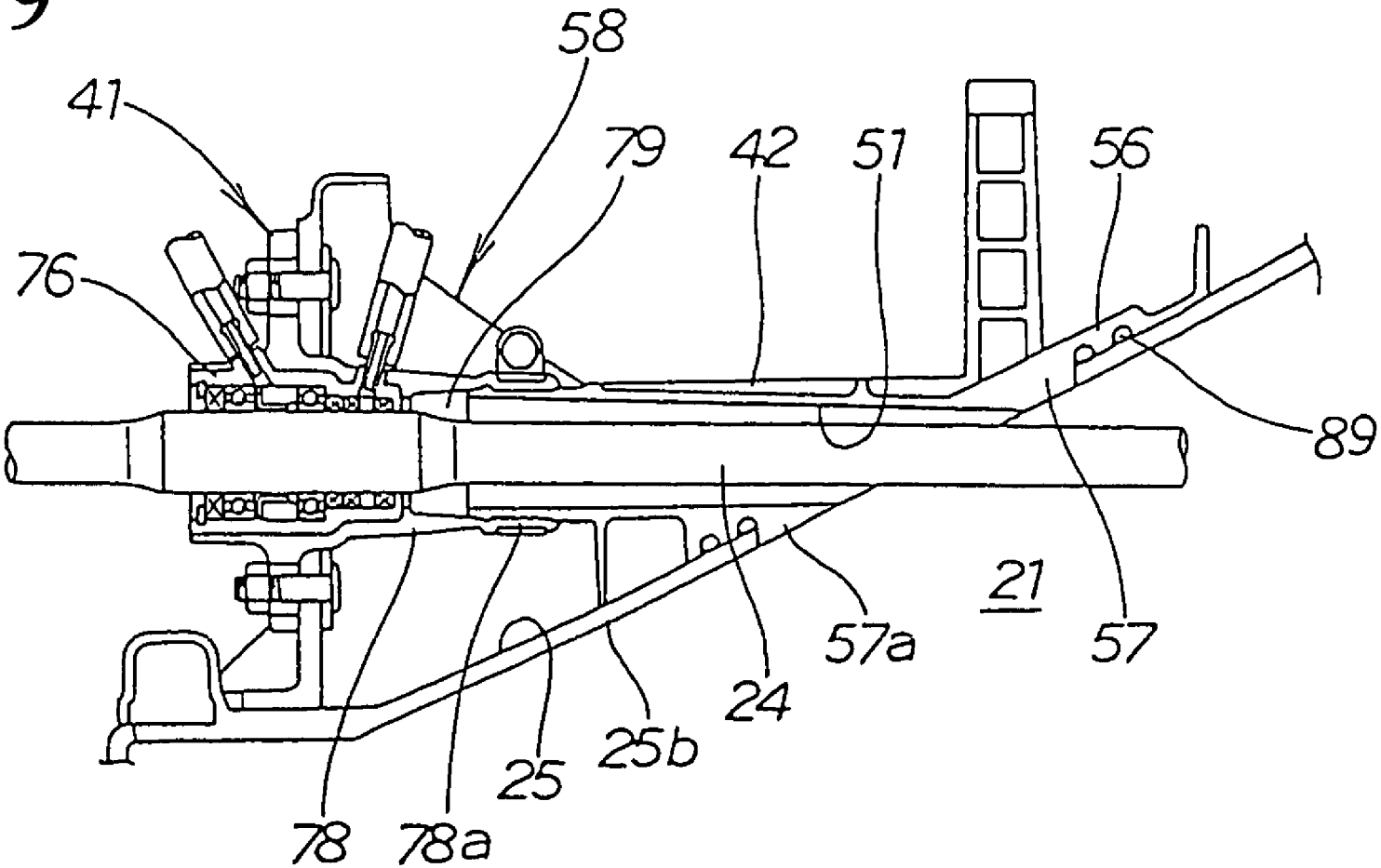
FIG. 9 is an explanatory drawing showing a state in which the shaft-supporting member and the cylindrical cradle member of the drive shaft supporting structure for a small boat according to the illustrative embodiment of the invention is fully assembled to the hull.

FIG. 9 is an explanatory drawing showing a state in which the shaft-supporting member and the cylindrical cradle member of the drive shaft supporting structure for a small boat according to the illustrative embodiment of the invention are assembled to the hull.

By fixing the shaft-supporting member 41 and the cylindrical cradle member 58 to the scoop 25, the passage 51 of the cylindrical sleeve 42 faces, and communicates with, the water introduction channel 21. In this state, the passage 51 of the cylindrical sleeve 42 faces the internal space 79 of the trailing cylindrical fitting portion 78. Therefore, the internal space 79 of the trailing cylindrical fitting portion 78 communicates with the water introduction channel 21 via the passage 51.

The bearing member 76 is provided forwardly of the internal space 79 of the trailing cylindrical fitting portion 78 and coaxially with the trailing cylindrical fitting portion 78 and the cylindrical sleeve 42. The drive shaft 24 is rotatably supported by the bearing member 76, and the drive shaft 24 is introduced into the water introduction channel 21 via the internal space 79 of the trailing cylindrical fitting portion 78 and the passage 51.

The cylindrical cradle member 58 or the shaft-supporting member 41 in the embodiment described above are not limited to those exemplified therein, and may be modified as needed.

According to the example described in the embodiment described above, the projection 57 is provided at the rear end portion 42*b* of the cylindrical sleeve 42 and the projection 57 is fitted in the opening 26 on the hull 12 side. However, the invention is not limited thereto, and the projection 57 does not have to be provided at the rear end portion 42*b*.

In the example described in the embodiment described above, the rear end portion 78*a* of the trailing cylindrical fitting portion 78 is fitted onto the outside of the front end portion 42*a* of the cylindrical sleeve 42. However, the invention is not limited thereto, and it is possible to fit the front end portion 42*a* of the cylindrical sleeve 42 onto the outside of the rear end portion 78*a* of the trailing cylindrical fitting portion 78.

The invention is suitable for being applied to a small boat provided with a drive shaft supporting structure for rotatably supporting a drive shaft for transmitting the output of the engine to the pump.

While a working example of the present invention has been described above, the present invention is not limited to the working example described above, but various design alterations may be carried out without departing from the present invention as set forth in the claims.

What is claimed is:

1. In a small boat of the type comprising:

a boat body having a hull and a deck, the hull constituting a lower part of the boat body and the deck covering the hull, wherein the hull has a downwardly directed recess formed in a rear bottom surface thereof, defining a water introduction channel at a front part of the recess, the water introduction channel configured and arranged to permit water entry into the recess during operation of the boat, the water introduction channel having a wall with an opening formed therein communicating with an interior portion of the hull, a pump which is operatively attached to a rear part of the water introduction channel, an engine provided in the boat body forward of the water introduction channel, and a drive shaft extending rearwardly from the engine in the boat body, the drive shaft passing through the opening provided on the wall of the water introduction channel, the drive shaft being operatively connected to the pump, the improvement comprising a drive shaft supporting structure for the small boat, the drive shaft supporting structure comprising:

a housing, a shaft-supporting member for supporting the drive shaft in a manner so as to permit rotation thereof, and a cylindrical sleeve arranged between the shaft-supporting member and the opening, the sleeve having a hollow interior passage through which the drive shaft extends, wherein the cylindrical sleeve and the shaft-supporting member are mounted from a position inside of the hull, wherein a front end portion of the cylindrical sleeve is connected to the shaft-supporting member, and a rear end portion of the cylindrical sleeve is connected to the opening, the rear end portion being flush with an exterior surface of the hull at the opening, and wherein the cylindrical sleeve is supported within the housing by a plurality of reinforcing panels which extend between the housing and the cylindrical sleeve.

2. The drive shaft supporting structure of claim 1, wherein the shaft-supporting member comprises a sealing member which seals a clearance between the shaft-supporting member and the drive shaft, and a resilient deformable cylindrical fitting member which extends in the rearward direction of the boat body along the periphery of the drive shaft, wherein an end portion of the cylindrical fitting member is fitted on the front end portion of the cylindrical sleeve.

3. The drive shaft supporting structure of claim 1, wherein the shaft-supporting member further comprises:

a sealing member disposed in the housing which seals a clearance between the shaft-supporting member and the drive shaft, and a resilient deformable cylindrical fitting member which extends from the housing in the rearward direction of the boat body along the periphery of the drive shaft, wherein an end portion of the cylindrical fitting member is fitted on the front end portion of the cylindrical sleeve in a watertight manner, and wherein the housing supports a drive shaft bearing member.

4. The drive shaft supporting structure of claim 1, wherein the rear end portion of the cylindrical sleeve comprises an expanded portion, the expanded portion being generally annular in shape and extending at an angle relative to a longitudinal axis of the cylindrical sleeve, the expanded portion comprising a rear face on a side opposed to the front end portion of the cylindrical sleeve, the rear face of the expanded portion comprising a rear face opening corresponding to the intersection of the hollow interior of the cylindrical sleeve and the rear face, a peripheral edge, and a protrusion extending rearwardly from the rear face, the protrusion spaced from the peripheral edge of the rear face and surrounding the rear face opening.

5. The drive shaft supporting structure of claim 4, wherein the rear face of the expanded portion further comprises at least one sealing member disposed between the peripheral edge and the protrusion.

6. The drive shaft supporting structure of claim 1, wherein the rear end portion of the cylindrical sleeve has a pair of opposed hook members formed on an upper side thereof, the hook members shaped to permit attachment of auxiliary components of the engine thereto.

7. A personal watercraft, comprising:

a boat body having a hull and a deck, the hull constituting a lower part of the boat body and the deck covering the hull, wherein the hull has a downwardly directed recess formed in a rear bottom surface thereof, defining a water introduction channel at a front part of the recess, the water introduction channel configured and arranged to permit water entry into the recess during operation of the boat, the water introduction channel having a wall with an opening formed therein communicating with an interior portion of the hull, a pump which is operatively attached to a rear part of the water introduction channel, an engine provided in the boat body forward of the water introduction channel, and a drive shaft extending rearwardly from the engine in the boat body, the drive shaft passing through the opening provided on the wall of the water introduction channel, the drive shaft being operatively connected to the pump, a drive shaft supporting structure disposed in the hull and comprising:

a housing, a shaft-supporting member for supporting the drive shaft in a manner so as to permit rotation thereof, and a cylindrical sleeve arranged in the housing between the shaft-supporting member and the opening, the sleeve having a hollow interior passage through which the drive shaft extends, wherein the cylindrical sleeve and the shaft-supporting member are mounted inside of the hull, wherein a front end portion of the cylindrical sleeve is connected to the shaft-supporting member, and a rear end portion of the cylindrical sleeve is connected to the opening, the rear end portion being flush with an exterior surface of the hull at the opening, and wherein the cylindrical sleeve is supported within the housing by a plurality of reinforcing panels which extend between the housing and the cylindrical sleeve.

8. The personal watercraft of claim 7, wherein the shaft-supporting member comprises a sealing member which seals a clearance between the shaft-supporting member and the drive shaft, and a resilient deformable cylindrical fitting member which extends in the rearward direction of the boat body along the periphery of the drive shaft, wherein an end portion of the cylindrical fitting member is fitted on the front end portion of the cylindrical sleeve.

9. The personal watercraft of claim 7, wherein the shaft-supporting member further comprises:

a sealing member disposed in the housing which seals a clearance between the shaft-supporting member and the drive shaft, and a resilient deformable cylindrical fitting member which extends from the housing in the rearward direction of the boat body along the periphery of the drive shaft, wherein an end portion of the cylindrical fitting member is fitted on the front end portion of the cylindrical sleeve in a watertight manner, and wherein the housing supports a drive shaft bearing member.

10. The personal watercraft of claim 7, wherein the rear end portion of the cylindrical sleeve comprises an expanded portion, the expanded portion being generally annular in shape and extending at an angle relative to a longitudinal axis of the cylindrical sleeve, the expanded portion comprising a rear face on a side opposed to the front end portion of the cylindrical sleeve, the rear face of the expanded portion comprising a rear face opening corresponding to the intersection of the hollow interior of the cylindrical sleeve and the rear face, a peripheral edge, and a protrusion extending rearwardly from the rear face, the protrusion spaced from the peripheral edge of the rear face and surrounding the rear face opening.

11. The personal watercraft of claim 10, wherein the rear face of the expanded portion further comprises at least one sealing member disposed between the peripheral edge and the protrusion.

12. The personal watercraft of claim 7, wherein the rear end portion of the cylindrical sleeve has a pair of opposed hook members formed on an upper side thereof, the hook members shaped to permit attachment of auxiliary components of the engine thereto.

13. A method of assembling a drive shaft supporting structure to a hull of a boat, the boat comprising:

a boat body having a hull and a deck, the hull constituting a lower part of the boat body and the deck covering the hull, wherein the hull has a downwardly directed recess formed in a rear bottom surface thereof, defining a water introduction channel at a front part of the recess, the water introduction channel configured and arranged to introduce water into the recess during operation of the boat, the water introduction channel having a wall with an opening formed therein communicating with an interior portion of the hull, a pump which is stored in the hull in a rear part of the recess, an engine provided in the boat body forward of the water introduction channel, and a drive shaft extending rearwardly from the engine in the boat body, the drive shaft passing through the opening provided on the wall of the water introduction channel, the drive shaft being operatively connected to the pump, wherein the method of assembling the drive shaft supporting structure to the hull comprises the steps of:

attaching a shaft-supporting member to a front end of a cylindrical sleeve to form a supportive unitary subassembly, and attaching the supportive unitary subassembly to an internal surface of the hull from a location inside of the hull so that a rear end portion of the cylindrical sleeve is mounted flush with an exterior surface of the hull at the opening, wherein a rear end portion of the cylindrical sleeve comprises an expanded portion, the expanded portion being generally annular in shape and extending at an angle relative to a longitudinal axis of the cylindrical sleeve, the expanded portion having a size which is greater than the hull opening and comprising a rear face on a side opposed to the front end portion of the cylindrical sleeve, the rear face of the expanded portion comprising a rear face opening corresponding to the intersection of the hollow interior passage of the cylindrical sleeve and the rear face, a peripheral edge, and a protrusion extending rearward from the rear face, the protrusion surrounding the rear face opening, the protrusion being spaced from the peripheral edge of the rear face, and having a diameter which permits the protrusion to be fitted within the hull opening, wherein the step of attaching the supportive unitary subassembly to an internal surface of the hull from the inside of the hull comprises a step of placing the expanded portion adjacent to the hull such that the protrusion is inserted into the hull opening in a fitted manner, and such that portions of the rear face between the protrusion and the peripheral edge of the rear face confront an inner surface of the hull.

14. The method of claim 13, wherein the shaft-supporting member comprises an outer cylindrical portion, and a drive shaft bearing member disposed in the outer cylindrical portion, a flange extending radially outwardly from the outside of the outer cylindrical portion, and a resilient deformable cylindrical fitting member which extends from the outer cylindrical portion in the rearward direction of the boat body, and wherein the step of attaching the shaft-supporting member to the front end of the cylindrical sleeve comprises:

mounting an end portion of the cylindrical fitting member about a front end portion of the cylindrical sleeve, encircling the end portion of the cylindrical fitting member with a tightenable band clamp, and adjusting the tightenable band clamp until the end portion of the cylindrical fitting member is secured to the front end portion of the cylindrical sleeve in a watertight manner.

15. The method of claim 14, wherein the drive shaft supporting structure further comprises a housing, and wherein an intermediate portion of the cylindrical sleeve is supported within the housing by a plurality of reinforcing panels which extend between the housing and the cylindrical sleeve, and wherein the housing comprises a front wall portion having an aperture formed therethrough, wherein the step of attaching the shaft-supporting member to the front end of the cylindrical sleeve further comprises inserting the end portion of the cylindrical fitting member through the aperture of the front wall portion prior to mounting the end portion of the cylindrical fitting member about the front end portion of the cylindrical sleeve, such that when the end portion of the cylindrical fitting member is mounted about the front end portion of the cylindrical sleeve, then the flange abuts the front wall portion of the housing.

16. The method of claim 13, wherein the rear face of the expanded portion further comprises at least one annular sealing member disposed between the peripheral edge and the protrusion.

* * * * *